US010501964B2

(12) United States Patent
Kashani

(10) Patent No.: US 10,501,964 B2
(45) Date of Patent: Dec. 10, 2019

(54) AXIAL LOCK

(71) Applicant: Ali Kashani, Houston, TX (US)

(72) Inventor: Ali Kashani, Houston, TX (US)

( * ) Notice: Subject to any disclaimer, the term of this patent is extended or adjusted under 35 U.S.C. 154(b) by 0 days.

(21) Appl. No.: 15/800,985

(22) Filed: Nov. 1, 2017

(65) Prior Publication Data

US 2019/0128023 A1 May 2, 2019

(51) Int. Cl.

| | |
|---|---|
| ***E05C 19/18*** | (2006.01) |
| ***E05B 63/14*** | (2006.01) |
| ***E05C 7/00*** | (2006.01) |
| ***E05B 65/00*** | (2006.01) |
| ***E05C 5/00*** | (2006.01) |
| *E05B 65/08* | (2006.01) |
| *E05B 65/06* | (2006.01) |
| *E05B 15/02* | (2006.01) |

(52) U.S. Cl.

CPC ..... *E05B 63/14* (2013.01); *E05B 65/0007* (2013.01); *E05C 5/00* (2013.01); *E05C 7/00* (2013.01); *E05C 19/186* (2013.01); *E05B 15/0205* (2013.01); *E05B 65/06* (2013.01); *E05B 65/08* (2013.01); *Y10T 292/34* (2015.04)

(58) Field of Classification Search

CPC ..... Y10T 292/34; Y10S 292/46; E05C 5/00; E05C 7/00; E05B 15/0205; E05B 63/14; E05B 63/143; E05B 65/06; E05B 65/08; E05B 65/0007

USPC ..... 292/1, 288, 289, 307 R; 70/14, 18, 19, 70/36, 37, 38 A, 53

See application file for complete search history.

(56) References Cited

U.S. PATENT DOCUMENTS

| | | | | |
|---|---|---|---|---|
| 716,118 | A * | 12/1902 | Scott | E05B 5/003 292/1 |
| 720,496 | A * | 2/1903 | Simpson | E05B 15/0053 292/156 |
| 853,507 | A * | 5/1907 | Fielding | E05D 11/1078 16/329 |
| 1,147,175 | A | 7/1915 | Keating | |
| 1,167,175 | A | 1/1916 | Hicks | |
| 1,315,568 | A | 9/1919 | Neidhammer | |

(Continued)

FOREIGN PATENT DOCUMENTS

| | | | | |
|---|---|---|---|---|
| EP | 1195489 | A1 | 10/2002 | |
| FR | 2657386 | A2 * | 7/1991 | E05B 13/001 |

(Continued)

*Primary Examiner* — Carlos Lugo

(74) *Attorney, Agent, or Firm* — John C. Cave

(57) ABSTRACT

An apparatus for engaging a locking mechanism having a first body, a second body, and two bolt assemblies. The first body having a longitudinal interior channel and recesses on each end. The second body having an interior channel. The bolt assemblies having first and second bolts, a connection member, and a tongue. The first bolt being insertable into the first body and slidable and rotatable therein. The second bolt being insertable into said second body and slidable therein. Engaging the lock by inserting the first bolt into the interior channel of the first body and the second bolt into the interior channel of the second body. The rotation of the bolt assemblies allows the user to align the second bolts with the channel of the second body. The tongue forms an interference fit with the recesses on the first body to hold the lock tightly in the locked position.

24 Claims, 6 Drawing Sheets

(56) References Cited

U.S. PATENT DOCUMENTS 1,336,505 A * 4/1920 Buggeln ..... E05B 67/383 292/1
1,404,557 A 1/1922 Stahl
1,452,393 A * 4/1923 Shek ..... E05L 367/22 70/38 C
1,496,172 A 3/1924 Rogers
1,571,024 A 1/1926 Scheid
1,690,041 A * 10/1928 Sundquist ..... E05B 67/383 292/281
1,711,972 A 5/1929 Seiler
1,873,644 A 7/1931 Harbert
1,900,503 A 3/1933 Kemp
2,264,962 A * 12/1941 Adams ..... E05B 65/0864 292/147
2,293,363 A 8/1942 Schell
2,508,302 A * 5/1950 Stue ..... E05L 367/003 70/19
2,911,814 A * 11/1959 Williams ..... A45C 13/18 109/45
2,983,133 A * 5/1961 Hruby ..... E05B 73/0076 70/14
3,583,738 A * 6/1971 Uphoff ..... E05C 7/00 292/114
3,627,365 A 12/1971 Mace
3,631,896 A * 1/1972 Meigs ..... B60R 25/042 138/89
3,739,607 A * 6/1973 Smedley ..... A63C 11/006 70/18
4,399,672 A * 8/1983 Moorhouse ..... E05C 19/18 292/289
4,438,641 A * 3/1984 Levkov ..... E05L 367/38 70/34
4,514,996 A * 5/1985 Sjogren ..... E05B 65/087 292/147
4,605,251 A * 8/1986 Finlay ..... E05C 19/18 292/147
5,255,542 A * 10/1993 Fortin ..... E05B 67/36 292/302
5,274,881 A 1/1994 DeRosa
5,681,066 A 10/1997 Anderson
5,934,719 A * 8/1999 Athanasios ..... E05B 65/087 292/145
5,987,939 A * 11/1999 Pitisettakarn ..... E05B 67/36 70/33
6,609,739 B1 * 8/2003 Avganim ..... E05B 67/36 292/288
6,746,092 B2 * 6/2004 Leccia ..... H02L 31/38 292/300
7,946,142 B2 * 5/2011 Matyko ..... E05B 67/36 292/302
8,272,625 B1 * 9/2012 Bassett ..... E05C 19/184 16/230
8,851,535 B2 * 10/2014 Miskel ..... E05C 19/186 292/258
9,546,507 B2 * 1/2017 Letson ..... E05C 19/184
D794,417 S * 8/2017 Hogan ..... D8/330
9,856,676 B2 * 1/2018 Leontaridis ..... E05B 17/2034
2009/0158792 A1 * 6/2009 Lasaroff ..... E05B 67/24 70/38 A
2014/0265360 A1 * 9/2014 Or Haim ..... E05C 9/008 292/160
2015/0059421 A1 * 3/2015 Kyllonen ..... E05B 35/08 70/37

FOREIGN PATENT DOCUMENTS

FR 2729705 A1 * 7/1996 ..... E05C 19/184
WO WO-9429553 A1 * 12/1994 ..... E05B 9/08

* cited by examiner

AXIAL LOCK

BACKGROUND OF THE INVENTION

1. Field of the Invention

The present invention relates generally to locking mechanisms for doors, windows or other types of barriers. More particularly, the present invention concerns a lock using a rotating bolt assembly.

2. Description of the Related Art

There are many types of locks ranging from simple clasp locks to complex electronic locks. Locks are generally used to control access through a barrier. Bolt locks are locks in which a bolt is maneuvered to engage or disengage a lock. The present invention is a novel design for a bolt lock.

Bolt locks exist in the prior art in which a bolt or bolts are maneuvered in and out of an intake piece in order to engage and disengage the lock. For example, U.S. Patent Application No. 2014/0265360 discloses a bolt lock in which two bolt assemblies mounted to a sliding door are maneuvered to connect with a receiving channel mounted to a door frame. The bolt assemblies are slideable but not rotatable. Consequently, the receiving channel must extend past the edge of the door frame to interact with the bolts mounted to the door. The extension of the receiving channel past the door frame limits use of this lock to sliding doors because the extension would prevent a swinging door from closing and/or opening.

It is desirable for a lock to work on both sliding and swinging barricades. The increased functionality improves the value and desirability of the lock. The present invention uses a dual rotating bolt assembly that makes the lock compatible with both sliding and swinging doors and windows. The rotation of the bolt assemblies allows the receiving channel to be mounted entirely on, and not extended from, the door and/or window frame.

BRIEF SUMMARY OF THE INVENTION

The present invention is directed to a locking mechanism for doors, windows, gates, or other barricades. The invention is a novel design for a bolt lock. It is anticipated that this invention could be adapted for use on any structure needing a lock, not just doors, windows, and gates. However, for convenience the remainder of the specification will refer to the lock in the context of use on a door.

The lock is comprised of a first body, a second body, and at least one, but preferably two, bolt assemblies. The first body and second body are attachable to or possibly integral with a door and door frame. Both the first and second body have longitudinal interior channels. Each bolt assembly has two bolts receivable within the channels of both the first body and the second body. The device is locked by receiving the bolt assemblies within both the channels. The lock is unlocked by removing the bolt assembly from the channel of the second body.

The first body is generally rectangular cuboid in shape with a longitudinal interior channel. The interior channel terminates at openings on either end of the first body. The first body also has a recess positioned at each end and sized to receive and create an interference fit with a tongue extending from each bolt assembly. The second body also comprises a longitudinal interior channel with a first and second opening. The second body is positioned so that its interior channel is parallel to the interior channel of the first body.

Each bolt assembly comprises first and second parallel bolts extending from a connection member. The first bolt is insertable into the interior channel of the first body, and is slidable and rotatable therein. The second bolt is insertable into the interior channel of the second body and is slidable therein. A tongue extends from the connection member and is positioned between the first and second bodies. The tongue is generally the same shape as the recesses on the main body and forms an interference fit therewith when the device is locked.

The first body has latitudinal cylindrical bores extending from the mounting surface through a portion of the body. The cylindrical bores are located near each end of the first body and partially intersect the longitudinal interior channel. Pins are insertable into the cylindrical bores and, when inserted, also partially intersect the interior channel forming a lip within the interior channel. Each of the first bolts have two circumferential notches which form a snap fit with the lips created by the pins when the first bolts are inserted into the interior channel of the first body and the lips are aligned with a notch. Rubber o-rings can be placed into the notches to further facilitate the snap fit between the bolt and the first body.

The lock is engaged by rotating each of the bolt assemblies until the second bolts are aligned with the interior channel of the second body and then inserted into the channel. With the bolt assemblies in the locked position, the interference fit between the tongue of each connection member and the recesses of the first body provide stability to the lock and resistance to movement. The lock is disengaged by pulling the bolt assemblies until the second bolts are removed from the channel of the second body. The bolt assemblies can then be rotated away from the second body to prevent re-locking.

DETAILED DESCRIPTION OF THE INVENTION

Figure 1:
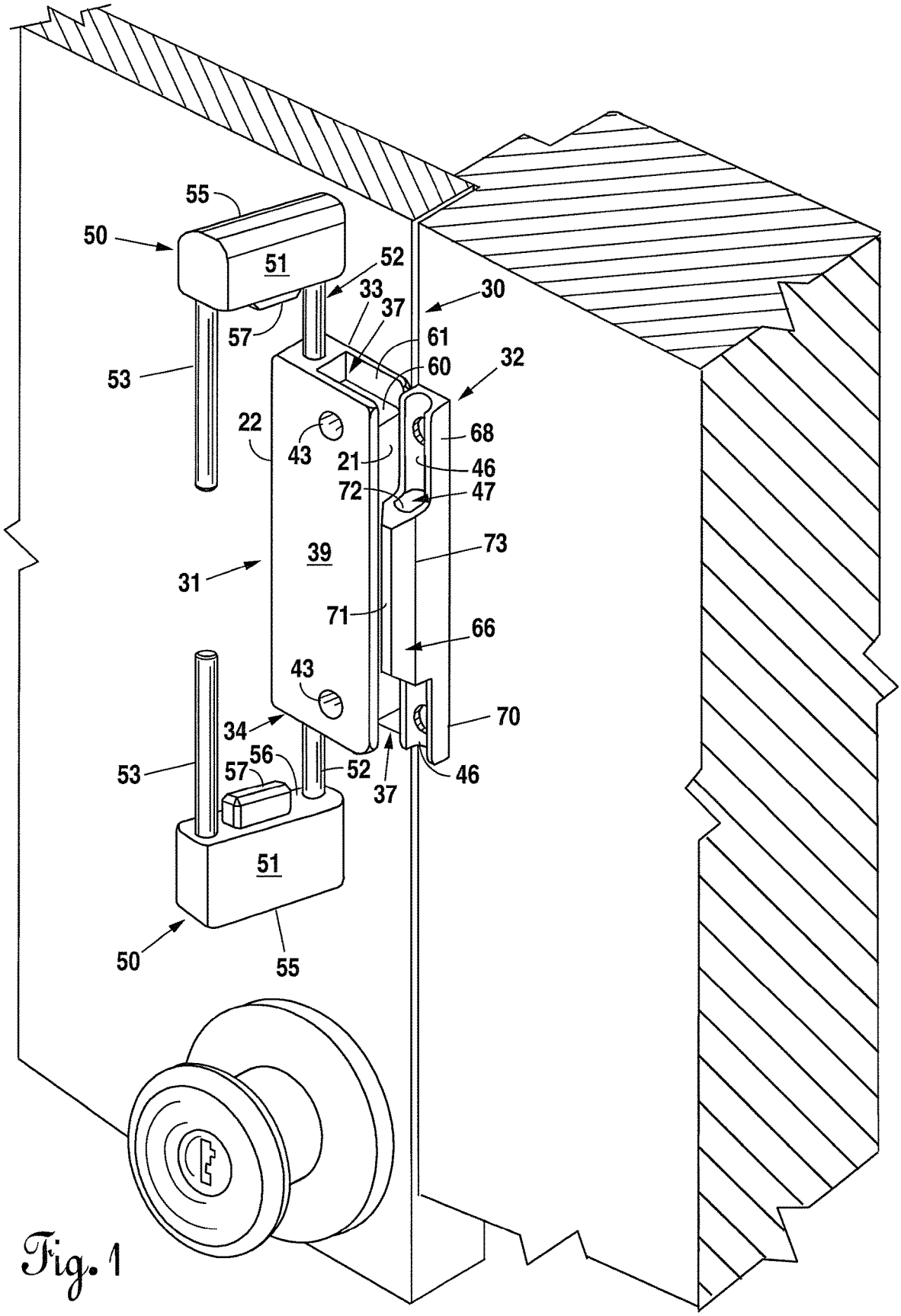
FIG. 1 is a perspective view of the device attached to a door and door frame and in the unlocked position.
Figure 2:
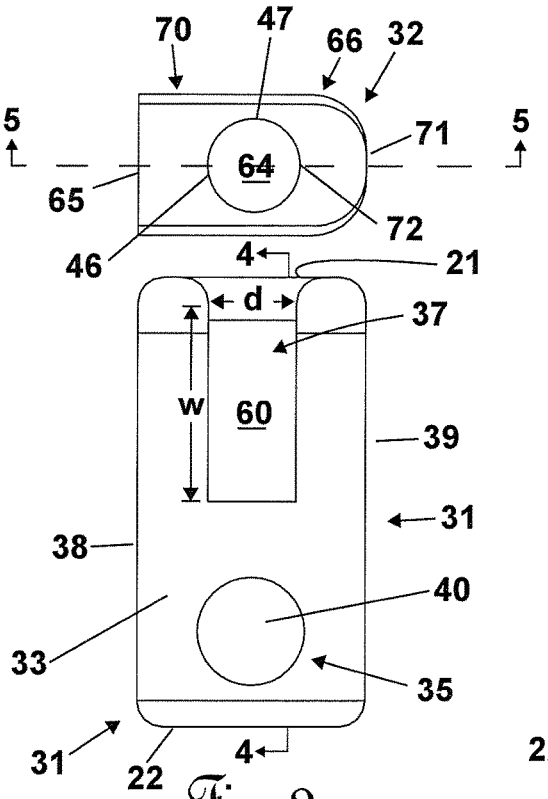
FIG. 2 a top view of the first and second bodies.

The structure of the lock is described with reference to FIG. 1-8*a*. Referring to FIGS. 1, 2, and 4, the lock 30 is comprised of a first body 31, a second body 32, and two bolt assemblies 50. The first body 31 is in the general shape of a rectangular cuboid and has a mounting surface 38, an exterior surface 39, a first endwall 33, a second endwall 34, a first sidewall 21, and a second sidewall 22. The first endwall 33, second endwall 34, first sidewall 21, and second sidewall 22 extend between the mounting surface 38 and the exterior surface 39. An interior channel 40 extends longitudinally through the first body terminating at a first opening 35 through the first endwall 33 and a second opening 36 through the second endwall 34. The interior channel 40 is parallel to said mounting surface 38.

A recess 37 is positioned at each endwall 33, 34 of the first body 31. Each recess 37 extends into the first body 31 from its respective endwall 33, 34, and from the first sidewall 21 at a position adjacent the respective endwall 33, 34. The recesses 37 have a bottom surface 60 and three side surfaces 61. Each of the recess surfaces 60, 61 is generally rectangular in shape. In the preferred embodiment, the width w of the recess 37 is approximately half the width of the first body 31, the depth d of the recess 37 is approximately forty percent of the width w of the recess 37, and the height h of the recess 37 is approximately half of the width w of the recess 37. The volume of each recess 37 is generally rectangular cuboid in shape and is centered between the mounting and exterior surfaces 38, 39 of the first body 31. The first and second openings 35, 36 of the channel 40 are positioned between the second sidewall 22 and the recesses 37.

Figure 3:
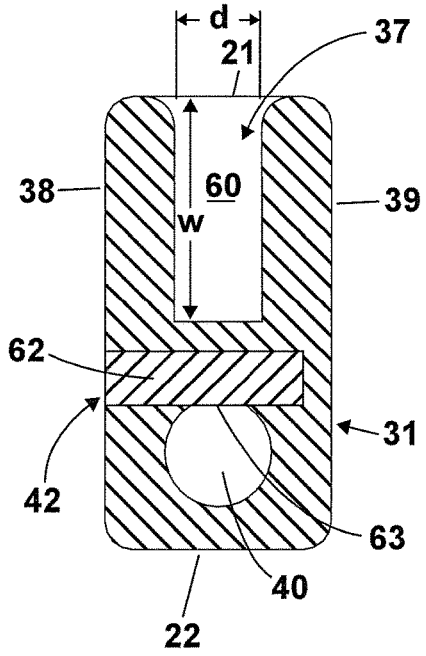
FIG. 3 is a cross section of the first body taken from a position on the first body represented by line 3-3 on FIG. 4.
Figure 4:
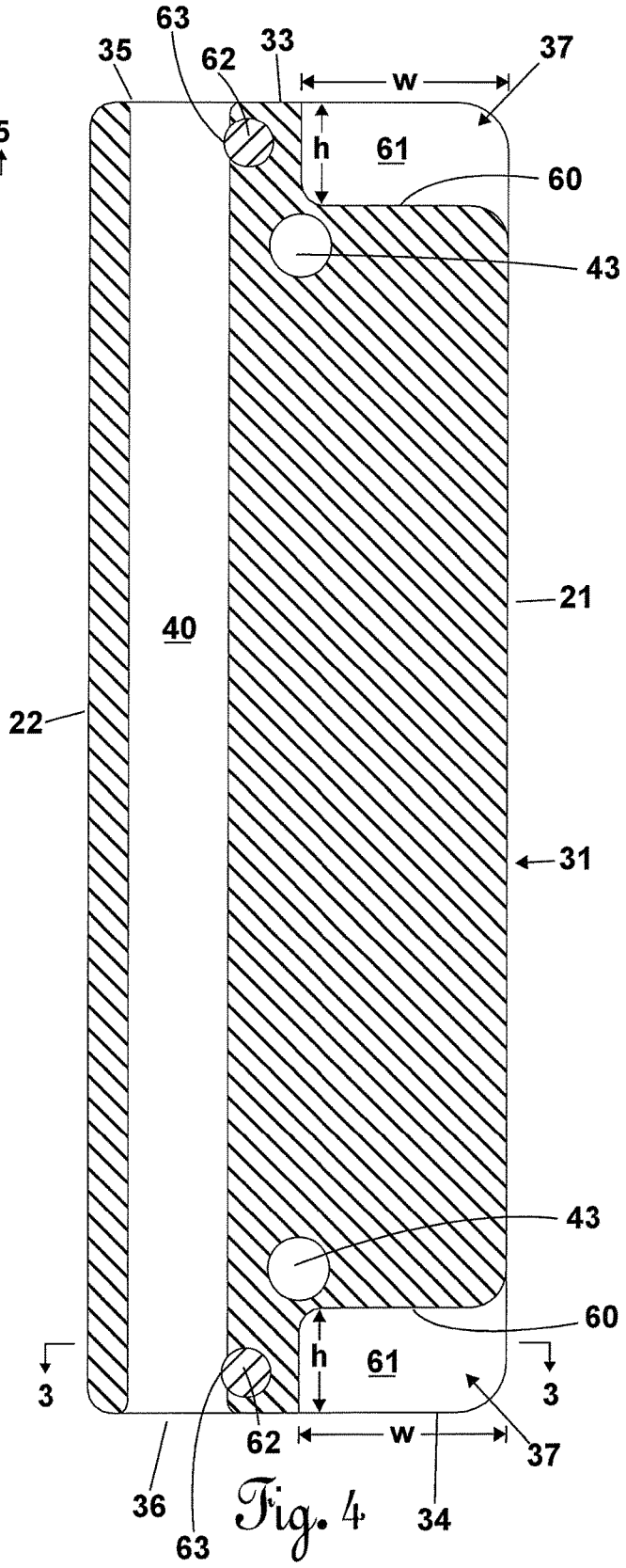
FIG. 4 is a cross section of the first body taken from a position represented by line 4-4 on FIG. 2.
Figure 5:
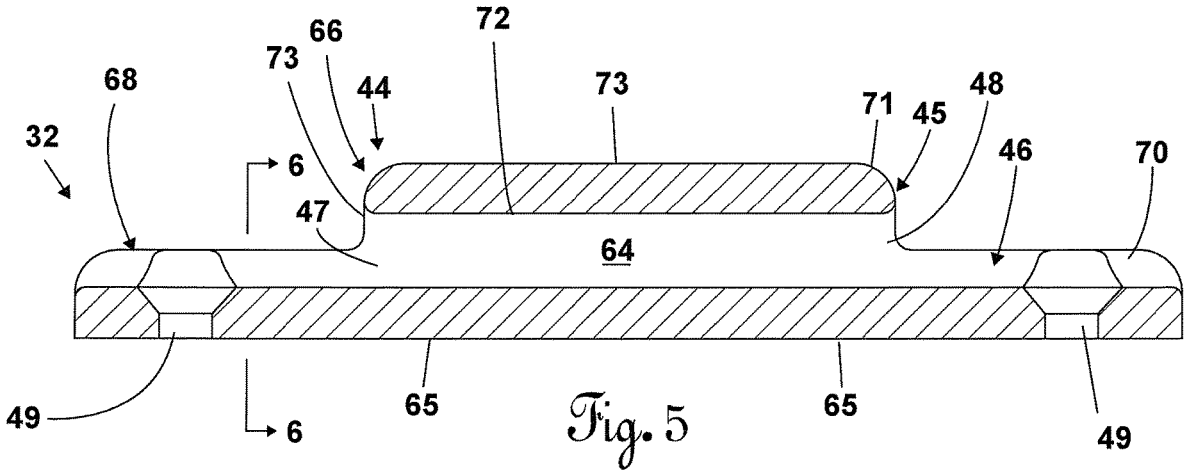
FIG. 5 is a cross section of the second body taken from a position represented by line 5-5 on FIG. 2.
Figure 6:
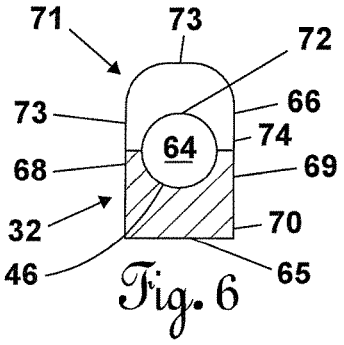
FIG. 6 is a cross section of the second body taken from a position represented by line 6-6 on FIG. 5.
Figure 8:
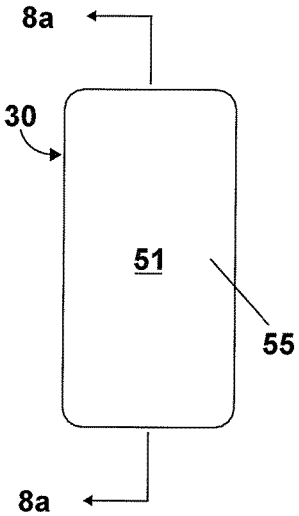
FIG. 8 is a top view of the device in the locked position.
Figure 8A:
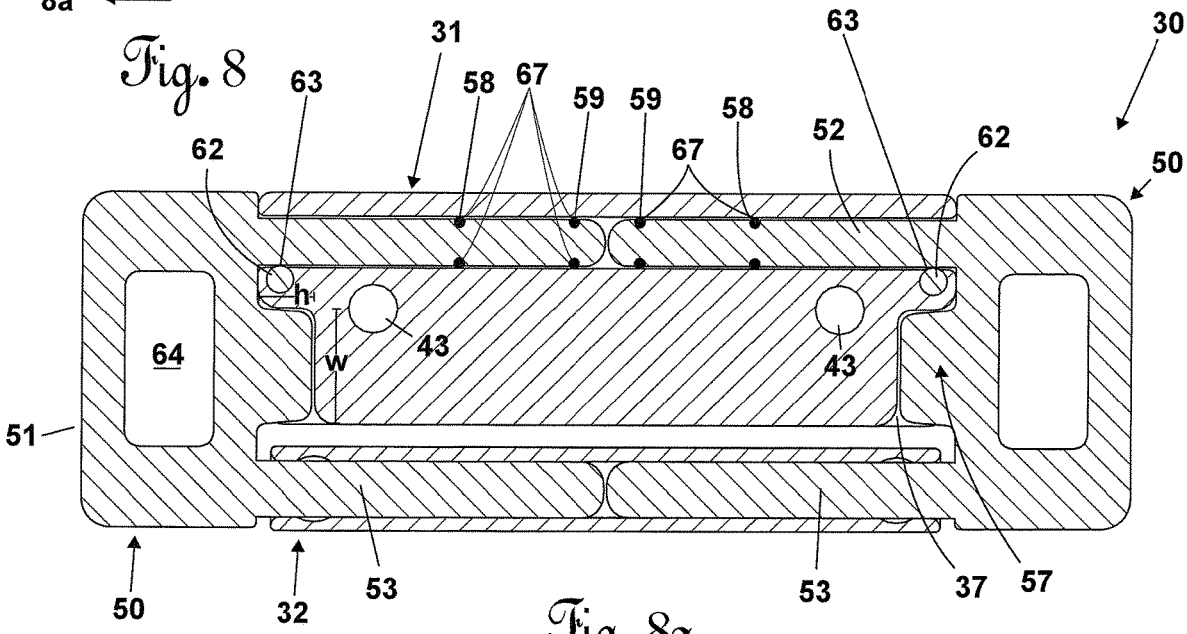
FIG. 8*a* is a cross section of the device in the locked position taken from a position represented by line 8*a* on FIG. 8.
Figure 9:
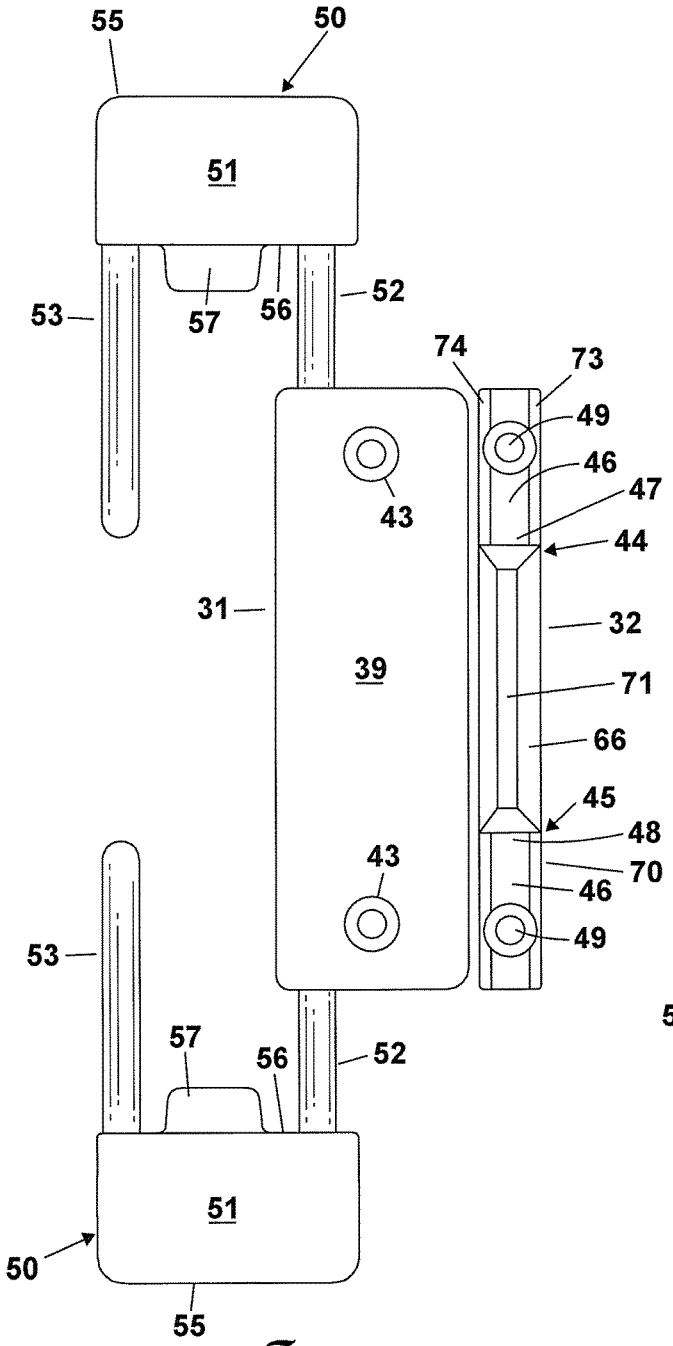
FIG. 9 is a front view of the device in the unlocked position with the bolt assemblies rotated 180 degrees away from the second body.
Figure 10:
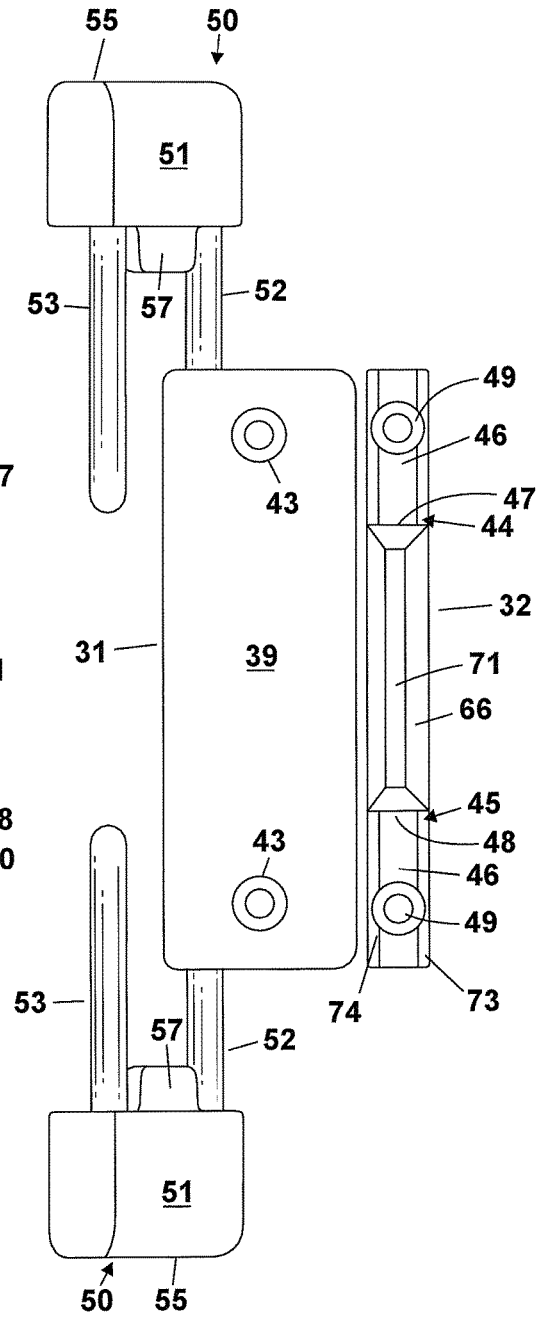
FIG. 10. is a front view of the device in the unlocked position with the bolt assemblies rotated towards the second body.
Figure 11:
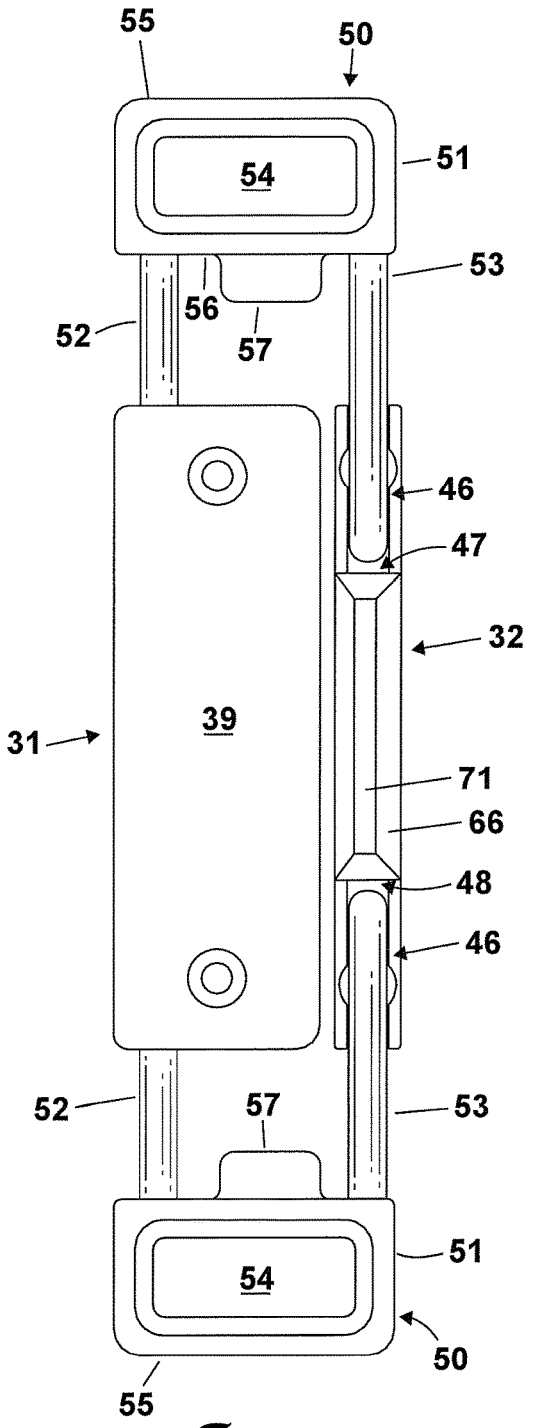
FIG. 11 is a front view of the lock in the unlocked position with the bolt assemblies aligned with the interior channel of the second body.
Figure 12:
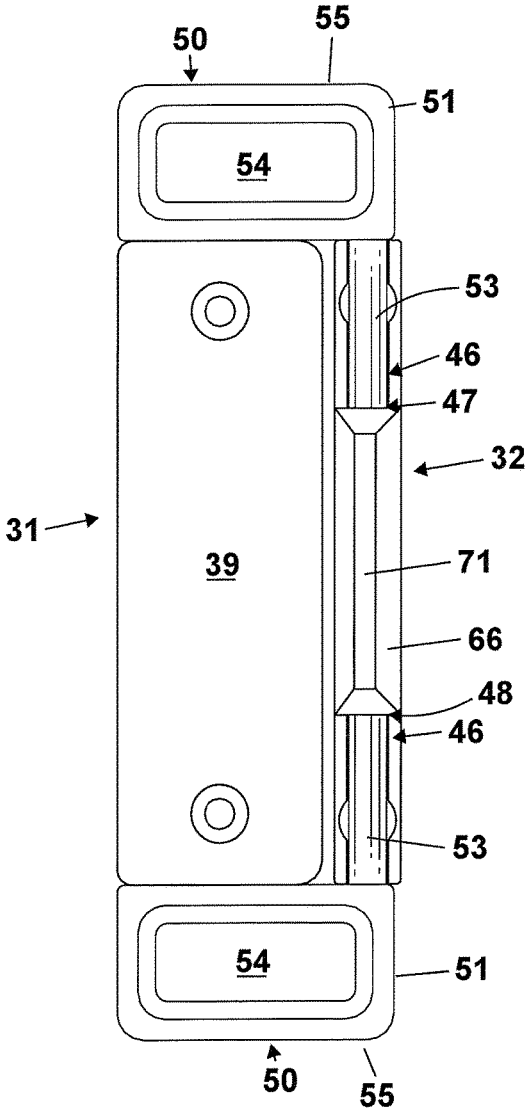
FIG. 12 is a front view of the device in the locked position.

Referring to FIGS. 3, 4, and 8*a*, The first body 31 has first and second latitudinal cylindrical bores 41 proximal to each of the first and second endwalls 33, 34. The cylindrical bores 41 extend from openings 42 on the mounting surface 38 into, but not completely though, the first body 31 and partially intersect with the interior channel 40. Pins 62 are insertable into the bores 41 and when inserted also partially intersect the interior channel 40. The pins, when inserted, form lips 63 on the interior channel 40 of the first body.

In the preferred embodiment, the first body 31 is constructed out of plastic and attachable to a door by screws. Screw holes 43 extend latitudinally through the first body 31 to facilitate attaching the first body to a door or door frame. In other embodiments, the first body 31 can be made of any suitable material, shaped differently, and/or attached to the door or door frame by different means.

Referring to FIGS. 1, 2, 5 and 6. The second body comprises a mounting portion 70 and an enclosure portion 66. The mounting portion 70 comprises a mounting surface 65, a first sidewall 68, a second sidewall 69, and a longitudinal semi-cylindrical channel 46 extending the length of the mounting portion. The first and second sidewalls 68, 69 extend perpendicularly from the mounting surface 65, and the semi-cylindrical channel 46 is centered between the first and second sidewalls 68, 69. Preferably, the diameter of the semi-cylindrical channel 46 is equal to or slightly larger than the diameter of the second bolt 53 of the bolt assemblies 50. When the second body 32 is mounted to a door or door frame, the second body is positioned so that the semi-cylindrical channel 46 is parallel to the interior channel 40 of the first body.

The enclosure portion 66 of the second body 32 is integral with the mounting portion 70 and positioned opposite the mounting surface 65. Preferably, the enclosure portion 66 is approximately half the length and longitudinally centered on the mounting portion 70. The enclosure portion 66 has an exterior surface 71 comprised of a first sidewall 73, a second sidewall 74, and an outer surface 73, and an interior surface 72. The first and second sidewalls 73, 74 of the enclosure portion extend from and are integral with the first and second sidewalls 68, 69 of the mounting portion 70. The interior surface 72 of the enclosure portion 66 has a semi-cylindrical concave shape. The diameter of the semi-cylindrical concave interior surface 72 is equal to the diameter of the semi-cylindrical channel 46 of the mounting portion 70. The semi-cylindrical concave interior surface 72 of the enclosure portion 66 combines with the partially enclosed semi-cylindrical channel 46 to form a fully enclosed cylindrical channel 64 through the enclosure portion 66 of the second body 32. The enclosed channel 64 has a first opening 47 at a first end 44 of the enclosure portion 66 and a second opening 48 at a second end 45 of the enclosure portion 66. In the preferred embodiment the outer surface 73 has a trapezoidal shape.

In the preferred embodiment the second body 32 is made out of plastic and the channel is generally cylindrically shaped. The second body is attachable to a door or door frame using screws. Screw holes 49 extend latitudinally through the second body 32 to facilitate attaching the first body to a door or door frame. In other embodiments, the second body 32 can be made of any suitable material, shaped differently, and/or attached to the door or door frame by different means.

Figure 7:
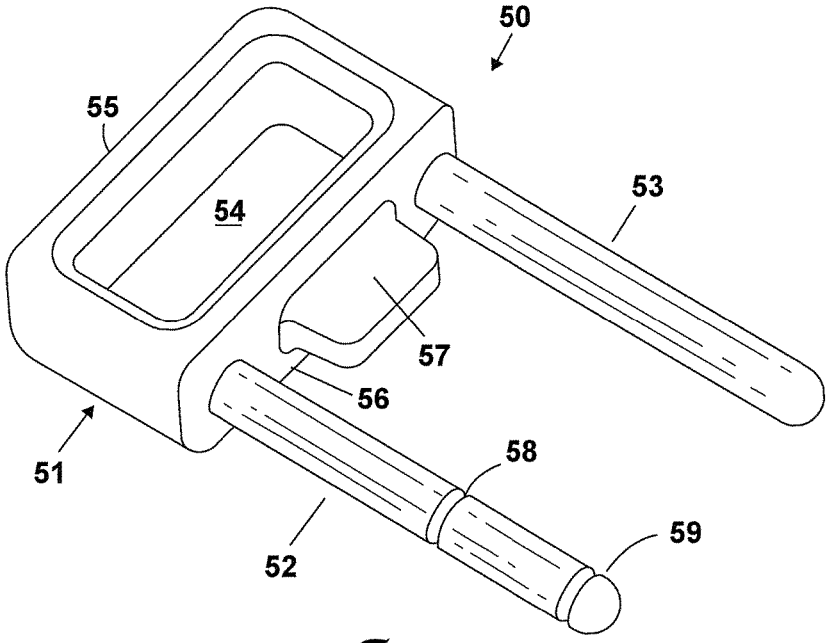
FIG. 7 is a perspective view of a bolt assembly.

Referring to FIGS. 1, and 7, two bolt assemblies 50, each comprising a connection member 51, a first bolt 52, and a second bolt 53, are associated with the first and second bodies. The connection member has a gripping cavity 54 providing space for user's fingers and a tongue 57. In the preferred embodiment, the tongue 57 is substantially the same shape as the volume of each recess 37 to create an interference fit when inserted therein. The connection member 51 has an outer endwall 55 and an inner endwall 56. The inner endwall 56 is proximal to the first and second bodies 31, 33. The first bolt 52, second bolt 53, and tongue 57 extend from the inner endwall 56 of the connection member toward the first and second bodies. Preferably, the tongue 57 is positioned between the first and second bolts 52, 53.

Referring to FIGS. 7 and 8*a*, each of the first bolts 52 has a circumferential first notch 58 and a circumferential second notch 59 in its surface to engage the lips 63 positioned in the interior channel 40 of the first body 31. The first notch 58 is positioned approximately midlength on each of the first bolts 52 to allow the distal ends of each of the second bolts 53 to clear the openings 47, 48 of the enclosure portion 66 of the second body 32 when the first notch 58 engages the lips 63 on the interior channel 40 of the first body 31. Each of the second circumferential notches 59 are located at the distal end of each of the first bolts to prevent the first bolts 52 from being fully removed from the interior channel 40 of the first body 31 when the second notches 59 engage the lips 63 on the interior channel 40 of the first body 31.

The operation of the preferred embodiment is explained with reference to FIG. 8*a*-12. The first bolts 52 of the bolt assemblies 50 are inserted through the first and second openings 35, 36, respectively, of the first body 31 and into the interior channel 40. The bolt assemblies 50 are slidable and rotatable at least 180 degrees within the interior channel 40 of the first body 31. The first and second circumferential notches 58, 59 of the first bolts 52 form a snap fit with lips 63 on the interior channel 40 of the first body 31 created by the pins 62 inserted into the bores 41. Rubber o-rings 67 can be placed around the circumferential notches 58, 59 to increase the resistance of the snap fit.

The snap fit between the lips 63 and the first notch 58 of each of the first bolts 52 provides resistance to the user indicating that the distal end of the second bolt 53 will not contact the enclosure portion 66 of the second body 32 if the bolt assemblies 50 are rotated or the door is opened. The snap fit between the lips 63 and the second notch 59 of each of the first bolts 52 provides resistance to the user indicating the first bolts 52 will be removed from interior channel 40 of the first body 31 if the bolt assembly 50 is pulled further away from the first body.

To engage the lock, the bolt assemblies 50 are pulled away from the first body 31. The resistance from the snap fit between the lips 63 and first circumferential notches 58 alerts the user that the bolt assemblies 50 have been pulled out enough to begin rotating. The bolt assemblies 50 are then rotated so that the second bolts 53 rotate toward the second body 32 until the second bolts 53 are aligned with and positioned in the semi-cylindrical channel 46 of the second body. The second bolts 53 may rest in the semi-cylindrical channel 46. Once aligned with the semi-cylindrical channel 46, the bolt assemblies 50 are pushed inwardly towards the first and second bodies 31, 32 and the second bolts 53 are inserted through the first and second openings 47, 48, respectively, of the enclosure portion 66 and into the enclosed channel 64 of the second body 32. The enclosure portion 66 of the second body 32 prevents the bolt assemblies 50 from rotating away from the locked position.

The connection members 51 of the bolt assemblies 50 are pushed toward the first and second bodies until the tongue of each bolt assembly 57 engages the surfaces 60, 61 of the recesses 37. The tongues 57 form an interference fit with the recesses 37 and hold the bolt assemblies 50 snuggly in the locked position and also provide stability to the lock. Unless a user applies an appropriate amount of force, the interference fit between the tongue 57 and recess 37 prevents the bolt assemblies 50 from moving away from the first and second bodies 31, 32.

The lock is disengaged by pulling the bolt assemblies 50 with enough force to overcome the resistance of the interference fit between the tongues 57 and recesses 37. The bolt assemblies 50 are pulled outwardly away from the first and second bodies 31, 32 until the second bolts 53 are removed from the enclosed channel 64 of the second body 32. The user can use the gripping cavity 54 on the connection member 51 to pull the bolt assemblies 50. As the bolt assemblies 50 are pulled, the snap fit between the lips 63 in the interior channel 40 of the first body 32 and the first notch 58 on each of the first bolts 52 will notify the user that the bolt assemblies are pulled far enough to remove the second bolts 53 from the enclosed channel 64. To maintain the unlocked position, the bolt assemblies 50 can be rotated away from the second body 32 to prevent reentry into the enclosed channel 64.

The lock 30 can be used on different types of closable barriers including doors, windows, and gates. The lock 30 can be used on barriers comprising a single moving member that slides or swings and a frame member. The lock 30 can be situated with the first body 31 attached to the moving member and the second body 32 attached to the frame member or vice versa. The lock 30 can also be used on barriers comprising two moving members (e.g. French doors). The first body 31 is attached to one moving member and the second body 32 is attached to the other moving member. Referring again to FIG. 1, the lock 30 is shown being used on a barrier in the form of a door. The first body 31 is attached to the moving member of the door and the second body 32 is attached to the frame member of the door.

Although the present invention has been described with reference to specific embodiments, this description is not meant to be construed in a limiting sense. Various modifications of the disclosed embodiments, as well as alternative embodiments of the invention will become apparent to persons skilled in the art upon the reference to the above-description of the invention. It is, therefore, contemplated that the appended claims will cover such modifications that fall within the scope of the invention.

The invention claimed is:

1. A lock comprising:

a first body and a second body;

said first body having a cylindrical interior channel and first and second recess;

said second body having an interior channel;

a first bolt assembly comprising a first bolt, a second bolt, and an connection member wherein both of said first and second bolts are connected to and extend from said connection member;

a tongue extending from said connection member of said first bolt assembly;

a second bolt assembly positioned at an opposite end of said first body from said first bolt assembly;

wherein said second bolt assembly comprises a first bolt, a second bolt, and a connection member wherein both of said first and second bolts are connected to and extend from said connection member;

a tongue extending from said connection member of said second bolt assembly;

said second body defining an enclosure portion positioned between mounting portions, the enclosure portion defining the interior channel and the mounting portions defining semi-cylindrical channels;

wherein, when the lock is in a locked position, the first bolts of the first and second bolt assemblies are insertable into the cylindrical interior channel of the first body, the second bolts of the first and second bolt assemblies are insertable into the interior channel of the second body, and the tongues of the first and second bolt assemblies are insertable into the first and second recesses and securable therein with an interference fit;

wherein, when the lock is moved into an unlocked position, the first and second bolt assemblies are slidable moved so that the tongues are removed from their respective recesses and the second bolts of the assemblies are moved to the semi-cylindrical channels, allowing the bolts assemblies to rotate with respect to the first bolts and move the second bolts away from the second body.

2. The lock of claim 1 wherein the first body has a first longitudinal end and a second longitudinal end, and wherein a first bolt assembly is positioned so that it extends from the first longitudinal end and said second bolt assembly is positioned so that it extends from the second longitudinal end.

3. The lock of claim 1 wherein said first bolt assembly is rotatable substantially 180 degrees while the first bolt is inserted into the interior channel of the first body.

4. The lock of claim 1 further comprising:

a lip positioned in interior channel of said first body; and first and second circumferential notches on the surface of said first bolt, wherein said first and second circumferential notches are positioned to engage said lip.

5. The lock of claim 4 further comprising:

at least one latitudinal bore in said first body partially intersecting said interior channel of said first body; and a pin inserted into said bore wherein a portion of said pin extends into said interior channel and forms said lip.

6. The lock of claim 1 wherein said connection member of said first bolt assembly has a gripping cavity.

7. The lock of claim 1 wherein said tongue is positioned between said first and second bolts.

8. The lock of claim 1 wherein:

said lock is attachable to a closable barrier;

said barrier selected from the group consisting of a door, window, or gate; and said barrier comprising a moving member and a frame member.

9. The lock of claim 8 wherein the first body is attached to said moving member of said barrier and the second body is attached to said frame member of said barrier.

10. The lock of claim 8 wherein the first body is attached to said frame member of said barrier and the second body is attached to said moving member of said barrier.

11. The lock of claim 1 wherein:

said lock is attachable to a closable barrier;

said barrier selected from the group consisting of a door, window, or gate; and said barrier comprising a first moving member and a second moving member.

12. The lock of claim 11 wherein said first body is attached to said first moving member and the second body is attached to said second moving member.

13. A closable barrier selected from the group consisting of a door, window, or gate, said barrier having a lock assembly comprising:

a first body of said lock assembly and a second body of said lock assembly;

said first body having a cylindrical interior channel and a first recess;

said second body having an interior channel;

a first bolt assembly of said lock assembly comprising a first bolt, a second bolt, and a connection member, wherein said first bolt and said second bolt are connected to and extend from said connection member;

a tongue extending from said connection member of said first bolt assembly;

a second bolt assembly positioned at an opposite end of said first body from said first bolt assembly;

wherein said second bolt assembly comprises a first bolt, a second bolt, and a connection member wherein both of said first and second bolts are connected to and extend from said connection member;

a tongue extending from said connection member of said second bolt assembly;

said second body defining an enclosure portion positioned between mounting portions, the enclosure portion defining the interior channel and the mounting portions defining semi-cylindrical channels;

wherein, when the lock is in a locked position, the first bolts of the first and second bolt assemblies are insertable into the cylindrical interior channel of the first body, the second bolts of the first and second bolt assemblies are insertable into the interior channel of the second body, and the tongues of the first and second bolt assemblies are insertable into the first and second recesses and securable therein with an interference fit;

wherein, when the lock is moved into an unlocked position, the first and second bolt assemblies are slidable moved so that the tongues are removed from their respective recesses and the second bolts of the assemblies are moved to the semi-cylindrical channels, allowing the bolts assemblies to rotate with respect to the first bolts and move the second bolts away from the second body.

14. The barrier of claim 13 wherein said first body of said lock assembly has a first longitudinal end and a second longitudinal end, and wherein said first bolt assembly is positioned so that it extends from the first longitudinal end and said second bolt assembly is positioned so that it extends from said second longitudinal end.

15. The barrier of claim 13 wherein said first bolt assembly is rotatable substantially 180 degrees while said first bolt is inserted into the interior cavity of said first body.

16. The barrier of claim 13 further comprising a lip positioned in the interior channel of said first body wherein first and second circumferential notches are positioned on said first bolt to engage said lip.

17. The barrier of claim 16 further comprising:

a latitudinal bore in said first body of said lock assembly partially intersecting said interior channel of said first body; and a pin inserted into said bore, wherein a portion of said pin extends into said interior channel and forms said lip.

18. The barrier of claim 13 wherein said first bolt assembly of said lock assembly has a recessed gripping cavity.

19. The barrier of claim 13 wherein said tongue of said lock assembly is positioned between said first and second bolt.

20. The barrier of claim 13 further comprising a moving member of said barrier and a frame member of said barrier.

21. The barrier of claim 20 wherein said first body is attached to said moving member and said second body is attached to said frame member.

22. The barrier of claim 20 wherein said first body is attached to said frame member and said second body is attached to said moving member.

23. The barrier of claim 13 comprising a first moving member of said barrier and a second moving member of said barrier.

24. The barrier of claim 23 wherein said first body is attached to said first moving member and said second body is attached to said second moving member.

* * * * *